US007322326B2

(12) United States Patent
Imaizumi et al.

(10) Patent No.: US 7,322,326 B2
(45) Date of Patent: Jan. 29, 2008

(54) VALVE TIMING CONTROL APPARATUS

(75) Inventors: Tatsuhiko Imaizumi, Kariya (JP); Takao Nojiri, Anjo (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/713,594

(22) Filed: Mar. 5, 2007

(65) Prior Publication Data

US 2007/0215085 A1 Sep. 20, 2007

(30) Foreign Application Priority Data

Mar. 15, 2006 (JP) ..... 2006-071387

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15
See application file for complete search history.

(56) References Cited

U.S. PATENT DOCUMENTS

2001/0003974 A1* 6/2001 Mizutani et al. ..... 123/90.17
2005/0115528 A1 6/2005 Imaizumi et al.
2005/0252468 A1 11/2005 Tanaka et al.

* cited by examiner

*Primary Examiner*—Zelalem Eshete
(74) *Attorney, Agent, or Firm*—Nixon & Vanderhye P.C.

(57) ABSTRACT

A valve timing control apparatus includes a driven shaft for actuating an intake valve and/or an exhaust valve of an engine. A housing member rotates together with a driving shaft of the engine. A rotor member is accommodated coaxially in the housing member for rotating together with the driven shaft. The rotor member is rotatable with respect to the housing member. The rotor member includes a rotor vane that circumferentially has a thick portion and a thin portion. The thick portion is greater than the thin portion in radial thickness. The rotor member further includes a bushing vane, in a substantially cylindrical shape, having one end. The one end is connectable to the rotor vane through a press-insertion hole with a compression margin relative to the thin portion. The one end is connectable to the rotor vane through a press-insertion hole without a compression margin relative to the thick portion.

14 Claims, 4 Drawing Sheets

VALVE TIMING CONTROL APPARATUS

CROSS REFERENCE TO RELATED APPLICATIONS

This application is based on and incorporates herein by reference Japanese Patent Application No. 2006-71387 filed on Mar. 15, 2006.

FIELD OF THE INVENTION

The present invention relates to a valve timing control apparatus.

BACKGROUND OF THE INVENTION

An internal combustion engine has an intake valve and an exhaust valve. Mixture gas of fuel and air is drawn into a combustion chamber of the engine through the intake valve. Combustion gas is exhausted through the exhaust valve. The intake valve and the exhaust valve open and close corresponding to a stroke of a piston axially moving in the combustion chamber of the engine.

A valve timing control apparatus is provided to an engine for enhancing fuel efficiency of the engine and for reducing emission from the engine. The valve timing control apparatus variably controls valve timing, when at least one of the intake valve and the exhaust valve opens and closes, in accordance with an operating condition of the engine.

The valve timing control apparatus includes a housing member and a rotor member that rotate relative to each other for controlling the valve timing. In general, one of the housing member and the rotor member rotates together with a cam and camshaft that actuates intake valve or exhaust valve of the engine. The other of the housing member and the rotor member is driven by a crankshaft of the engine. In general, a hydraulic pressure device is provided to control a relative angular position, i.e., relative phase between the housing member and the rotor member.

According to US2005/0252468A1 (JP-A-2005-325758), a valve timing control apparatus includes a housing member, a vane rotor, and a torsion coil spring. The torsion coil spring biases the vane rotor in a specific rotative direction with respect to the housing member. The housing member includes a shoe housing and a sprocket. The shoe housing has island portions each partitioning a hydraulic chamber in the shoe housing. The outer periphery of the rotor member (rotor vane) has vane portions each rotative in the hydraulic chamber relative to the housing member. The vane rotor has one axial end, to which a camshaft is fixed, and the other axial end, to which a spring plate (bushing vane) is provided.

In this valve timing control apparatus of US2005/0252468A1, a hydraulic device rotates the vane portion, accommodated in the hydraulic chamber, relative to the housing member, thereby controlling the relative phase between the crankshaft and the camshaft. Thus, the valve timing control apparatus controls the valve timing.

In this valve timing control apparatus, the vane rotor has one axial end having an engage hole in which the camshaft engages. The axes of the vane rotor and the camshaft are fixed by screwing a bolt. The vane rotor has the other end having an annular press-insertion hole, to which an end of a substantially cylindrical spring plate is press-inserted, so that the vane rotor is integrated with the spring plate. Specifically, first, the spring plate is integrated to the vane rotor, and subsequently, the camshaft is assembled to the vane rotor. When the spring plate is press-inserted into the press-insertion hole of the vane rotor, stress is applied to the vane rotor, and the stress further causes deformation in the engage hole axially on the opposite side of the press-insertion hole. The vane rotor has the thick portions, each having the vane portion, and the thin portions, each not having the vane portion. The thick portion and the thin portion are circumferentially arranged alternately one another. When the stress is applied to the vane rotor due to the press-insertion, the thin portion deforms substantially only in the vicinity of the press-insertion hole. However, in this press-insertion, the thick portion being high in rigidity broadly deforms therein, consequently, the deformation in the thick portion exerts influence to a distant portion such as the engage hole in the vane rotor. When the engage hole largely deforms, and the dimension of the engage hole is out of the dimensional tolerance thereof, the camshaft cannot be inserted properly into the engage hole.

SUMMARY OF THE INVENTION

The present invention addresses the above disadvantage. According to one aspect of the present invention, a valve timing control apparatus is provided for controlling at least one of an intake valve and an exhaust valve of an internal combustion engine having a driving shaft. The valve timing control apparatus includes a driven shaft for actuating the at least one of the intake valve and the exhaust valve. The valve timing control apparatus further includes a housing member for rotating together with one of the driven shaft and the driving shaft. The valve timing control apparatus further includes a rotor member accommodated coaxially in the housing member for rotating together with an other of the driven shaft and the driving shaft. The rotor member is rotatable with respect to the housing member in a predetermined angular range. The rotor member includes a rotor vane that has a thick portion, which constructs a circumferential part of the rotor vane, and a thin portion, which constructs a circumferential part of the rotor vane other than the thick portion. The thick portion is greater than the thin portion in thickness with respect to a radial direction of the rotor vane. The rotor vane has one end surface defining an engage hole in which the other of the driven shaft and the driving shaft engages. The rotor vane has an other end surface defining a press-insertion hole. The rotor member further includes a bushing vane, in a substantially cylindrical shape, having one end. The one end of the bushing vane is connectable to the rotor vane through the press-insertion hole with a compression margin relative to the thin portion. The one end of the bushing vane is connectable to the rotor vane through the press-insertion hole without a compression margin relative to the thick portion.

According to another aspect of the present invention, a valve timing control apparatus is provided for controlling at least one of an intake valve and an exhaust valve of an internal combustion engine having a driving shaft. The valve timing control apparatus includes a driven shaft for actuating the at least one of the intake valve and the exhaust valve. The valve timing control apparatus further includes a housing member for rotating together with one of the driven shaft and the driving shaft. The valve timing control apparatus further includes a rotor member accommodated coaxially in the housing member for rotating together with an other of the driven shaft and the driving shaft. The rotor member is rotatable with respect to the housing member in a predetermined angular range. The rotor member includes a rotor vane that has a plurality of thick portions and a plurality of thin portions. Each of the plurality of thick portions and each of the plurality of thin portions are circumferentially arranged one another to define a press-insertion hole therein with respect to a radial direction of the rotor vane. Each of the plurality of thick portions is greater than each of the plurality of thin portions in thickness with respect to the radial direction. The rotor member further includes a bushing vane, in a substantially cylindrical shape, having one end. The one end of the bushing vane is connectable to the rotor vane through the press-insertion hole with a compression margin relative to the thin portion. The one end of the bushing vane is connectable to the rotor vane through the press-insertion hole without a compression margin relative to the thick portion.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1A:
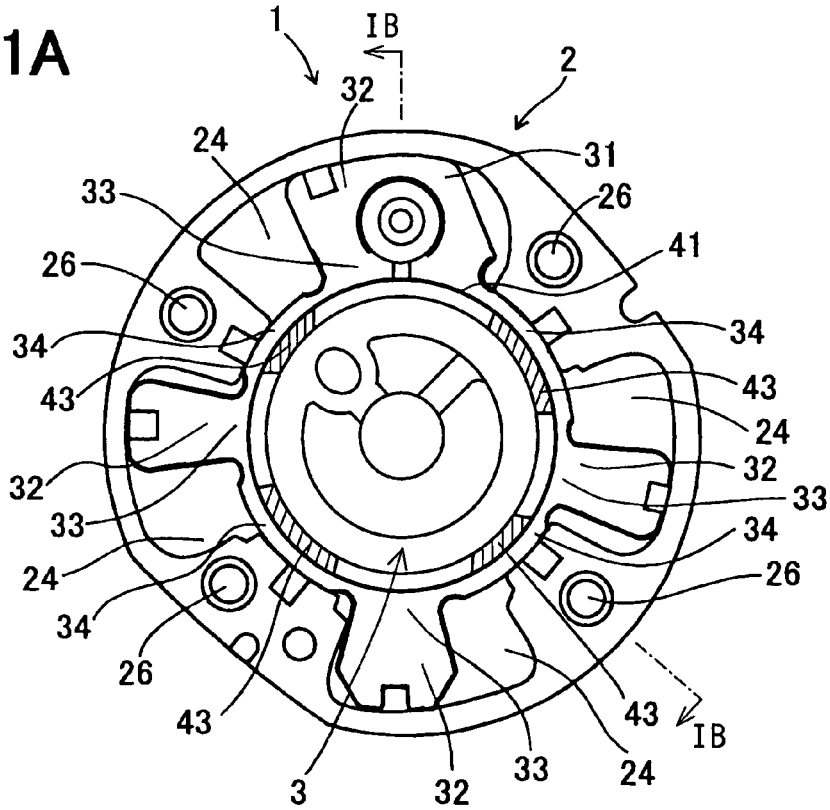
FIG. 1A is a sectional front view showing a valve timing control apparatus according to a first embodiment.
Figure 1B:
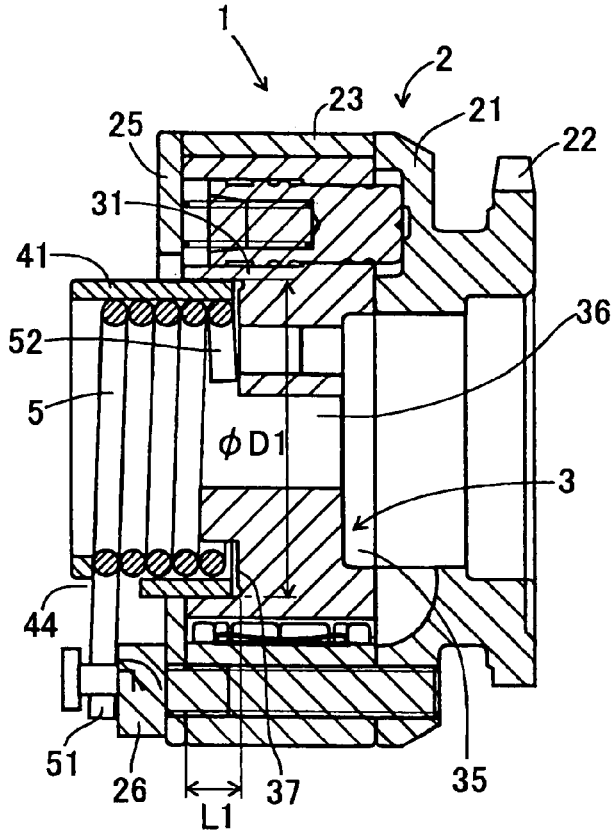
FIG. 1B is a sectional view taken along the line IB-IB in FIG. 1A.
Figure 4:
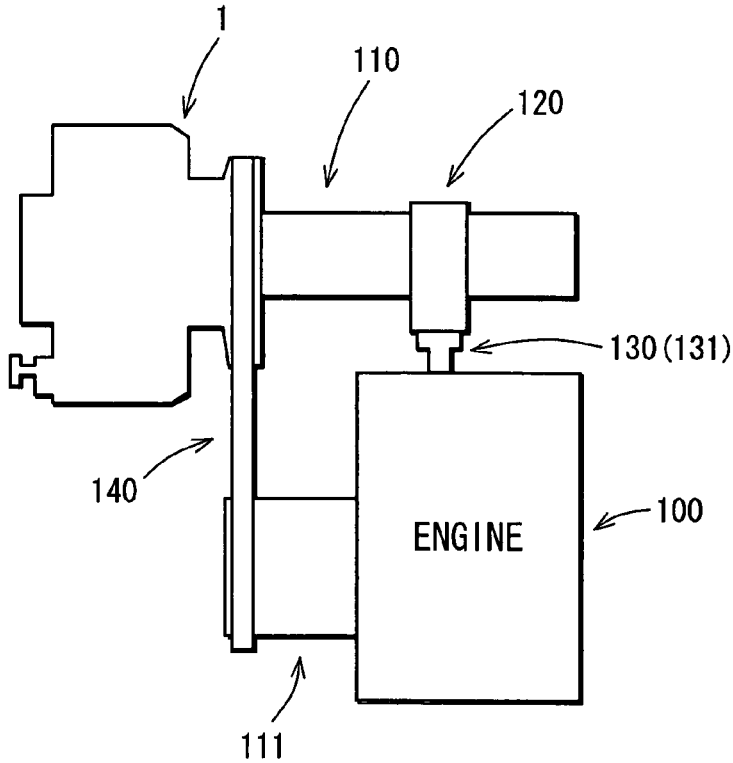
FIG. 4 is a schematic view showing the valve timing control apparatus provided to an internal combustion engine.

As shown in FIGS. 1A, 1B, 4, a valve timing control apparatus 1 includes a housing member 2, a rotor member 3, a coil spring 5, and a camshaft (FIG. 4) 110. The camshaft 110 serves as a driven shaft 110. An internal combustion engine 100 has a crankshaft (output shaft) 111. The crankshaft 111 serves as a driving shaft 111. The housing member 2 is coupled with the crankshaft 111 of the engine 100 via a transmission device 140 such as a belt and a chain, so that the housing member 2 is rotatable in conjunction with the crankshaft 111. The camshaft 110 has a cam 120 to open and close at least one of an intake valve 130 and an exhaust valve 131.

As referred to FIG. 1B, the housing member 2 is constructed of an axial support 21, a housing body 23, and a front plate 25 that are axially screwed by, for example, four bolts 26. The axial support 21 rotatably supports the camshaft 110 (FIG. 4) therein. The axial support 21 has the outer circumferential periphery provided with a sprocket 22. The axial support 21 of the housing member 2 is rotatable in conjunction with the crankshaft 111 (FIG. 4) via the transmission device 140 engaged with the sprocket 22. The housing body 23 has one axial end surface via which the housing body 23 is connected with the axial support 21 on the right side in FIG. 1B. The housing body 23 has the other axial end surface via which the housing body 23 is connected with the front plate 25 on the left side in FIG. 1B. The housing body 23 has a cavity provided with island portions. The cavity of the housing body 23 is partitioned into four hydraulic chambers 24 by the island portions. Each of the hydraulic chambers 24 is applied with hydraulic pressure from a hydraulic device (not shown) through a hydraulic passage. The front plate 25 is constructed of a substantially annular plate for sealing the cavity defined by hydraulic chambers 24. In FIG. 1A, the front plate 25 and the coil spring 5 are omitted.

As referred to FIG. 3B, the rotor member 3 is constructed by press-inserting a substantially cylindrical bushing vane 41 into the rotor vane 31 from the left side in FIG. 1B. The rotor vane 31 is in a substantially cylindrical shape. Four vane portions 32 protrude from the outer circumferential periphery of the rotor vane 31. Each of the four vane portions 32 is accommodated in each of the hydraulic chambers 24 of the housing member 2, such that the four vane portions 32 are movable relative to the housing member 2. The rotor vane 31 has thick portions 33 to which the vane portions 32 are provided. The rotor vane 31 has thin portions 34 each arranged between two of the thick portions 33 with respect to the circumferential direction of the rotor vane 31. The thin portions 34 are in a simple cylindrical shape. The end surface of the rotor vane 31 on the right side in FIG. 1B defines an engage hole 35. The rotor vane 31 has a screw hole 36 that is a through hole extending along the axis of rotor vane 31. The camshaft 110 has the outer diameter that is slightly less than the inner diameter of the engage hole 35. The camshaft 110 is inserted into the axial support 21 from the right side in FIG. 1B, and is engaged with the engage hole 35 through the axial support 21. A screw bolt (not shown) is inserted to the screw hole 36 from the left side in FIG. 1B, and is fixed to the camshaft 110, so that the rotor vane 31 is integrally coupled with the camshaft 110. The end surface of the rotor vane 31 on the left side in FIG. 1B defines a press-insertion hole 37 in a substantially annular shape. The press-insertion hole 37 has the outer diameter D1 and the depth L1.

The bushing vane 41 is constructed of a substantially cylindrical member having notches 42 partially therein.

Figure 2A:
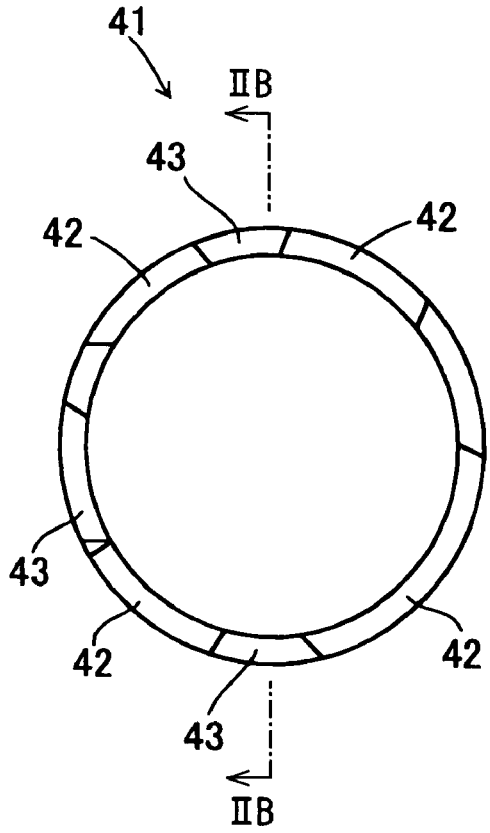
FIG. 2A is a front view showing a bushing vane of the valve timing control apparatus.
Figure 2B:
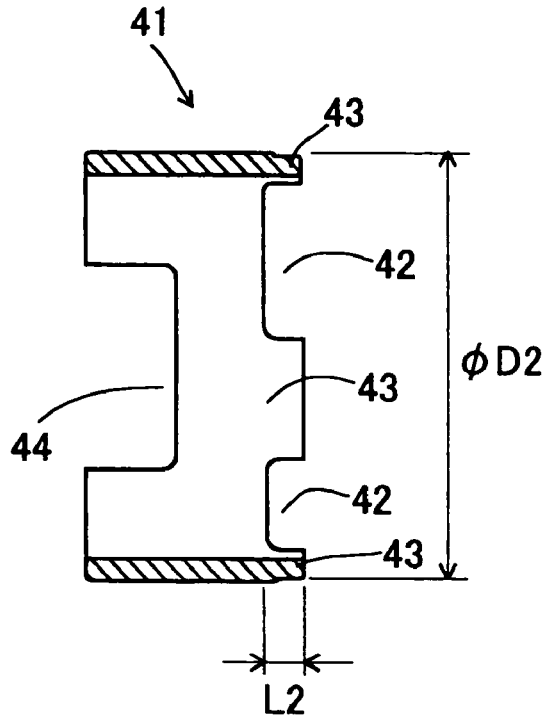
FIG. 2B is a sectional view taken along the line IIB-IIB in FIG. 2A.

As shown in FIG. 2B, the end surface of the bushing vane 41 on the right side in FIG. 2B has the outer diameter D2, which is slightly greater than the diameter D1 of the press-insertion hole 37 (D2>D1). The difference D2−D1 between the outer diameter D2 of the end surface of the bushing vane 41 and the diameter D1 of the press-insertion hole 37 defines an overlap margin, i.e., compression margin. The bushing vane 41 has four of the notches 42 that are opposed to the thick portions 33 when the bushing vane 41 is press-inserted into the rotor vane 31. Each of the four notches 42 has the axial length L2. The axial length L2 is equal to or slightly greater than the depth L1 of the press-insertion hole 37 (L2≧L1). The bushing vane 41 has four press-inserted portions (protrusions) 43 in addition to the four notches 42. The four press-inserted portions 43 extend from the end of the bushing vane 41 to the right side in FIG. 2B. Each of the four press-inserted portions 43 is arranged circumferentially between two of the four notches 42. The bushing vane 41 has a spring notch 44 on the left side in FIG. 2B.

The bushing vane 41 depicted in FIG. 2B is press-inserted into the rotor vane 31 to be in the condition of FIG. 1B. Specifically, the four press-inserted portions 43 are press-inserted respectively into a part of the press-insertion hole 37 defined by the thin portions 34 radially therein. That is, the four press-inserted portions 43 are press-inserted into the radially inside of the thin portions 34. In this press-insertion, the outer diameter D2 of the four press-inserted portions 43 is forcedly reduced to the diameter D1 of the press-insertion hole 37. In this condition, the four press-inserted portions 43 and the thin portions 34 deform, so that stress is caused therein, thereby being joined therebetween. In this condition, the press-insertion is, substantially, not performed in the thick portions 33, to which the notches 42 are opposed. That is, the thick portions 33 are way from the portion in which the press-insertion is performed in the bushing vane 41.

The bushing vane 41 is press-inserted, and subsequently, the coil spring 5 is assembled. Specifically, the coil spring 5 has one end 51 that is hooked to a bolt head of one of the bolts 26, which is screwed into the housing member 2. The coil spring 5 is inserted into the bushing vane 41 through the spring notch 44. The coil spring 5 has the other end 52 that is hooked to the rotor vane 31. Thus, the coil spring 5 is assembled to the housing member 2, the bushing vane 41, and the rotor vane 31.

Thus, the valve timing control apparatus 1 is constructed. In this valve timing control apparatus 1, substantially only the press-inserted portions 43 in the end of the bushing vane 41 is press-inserted into the radially inside of the thin portion 34 partially defining the press-insertion hole 37 in the rotor vane 31. In this structure, deformation due to stress caused in the components is restricted substantially within the vicinity of the press-insertion hole 37. Therefore, the engage hole 35 on the axially opposite side of the press-insertion hole 37 can be substantially protected from the stress and deformation arising in the vicinity of the press-insertion hole 37.

Figure 5A:
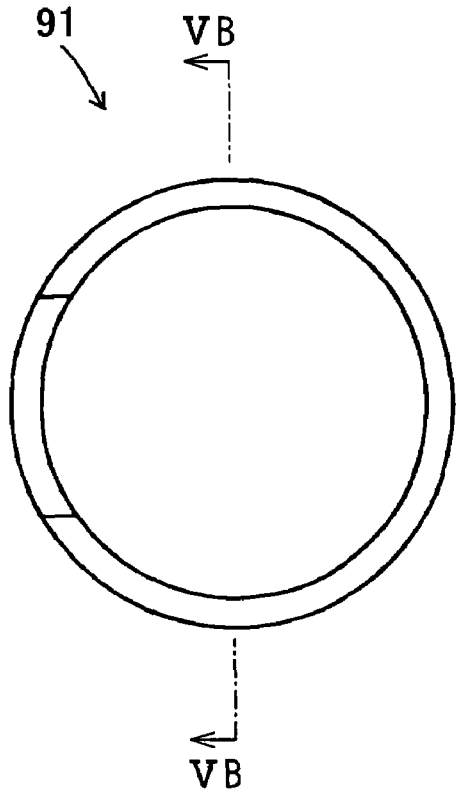
FIG. 5A is a front view showing a bushing vane according to a related art.
Figure 5B:
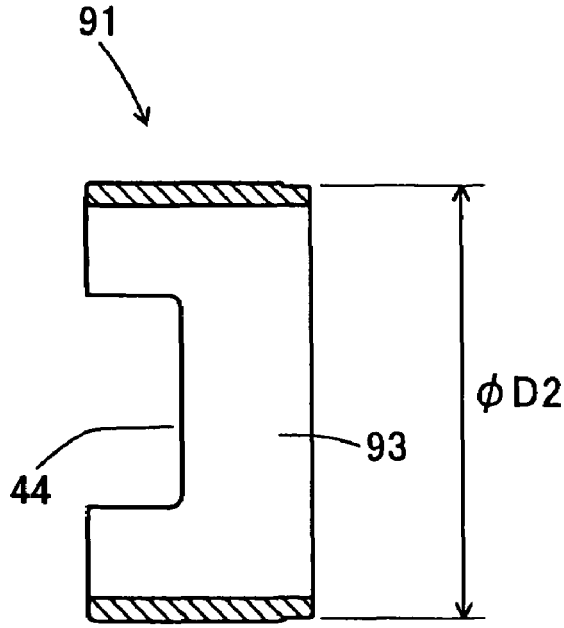
FIG. 5B is a sectional view taken along the line VB-VB in FIG. 5A.

By contrast, a conventional bushing vane 91 shown in FIGS. 5A, 5B does not have a notch in the end thereof on the right side in FIG. 5B. This end of the conventional bushing vane 91 has the circumferential periphery that entirely defines a press-inserted portion 93 on the right side in FIG. 5B. Therefore, in this conventional structure, the press-inserted portion 93 is press-inserted into the radially inner side of the thick portions 33, as well as the radially inner side of the thin portions 34 defining the press-insertion hole 37 when the conventional bushing vane 91 is press-inserted into the rotor vane 31. As a result, stress arises in the thick portions 33, which is high in rigidity, and deformation caused in the thick portions 33 is transmitted to the axially opposite side of the rotor vane 31 through the rotor vane 31, and consequently, the engage hole 35 may be deformed.

On the contrary, in the valve timing control apparatus 1 of this embodiment, the engage hole 35 can be restricted from causing deformation by defining the compression margin partially in the end of the bushing vane 41.

Second Embodiment

Figure 3:
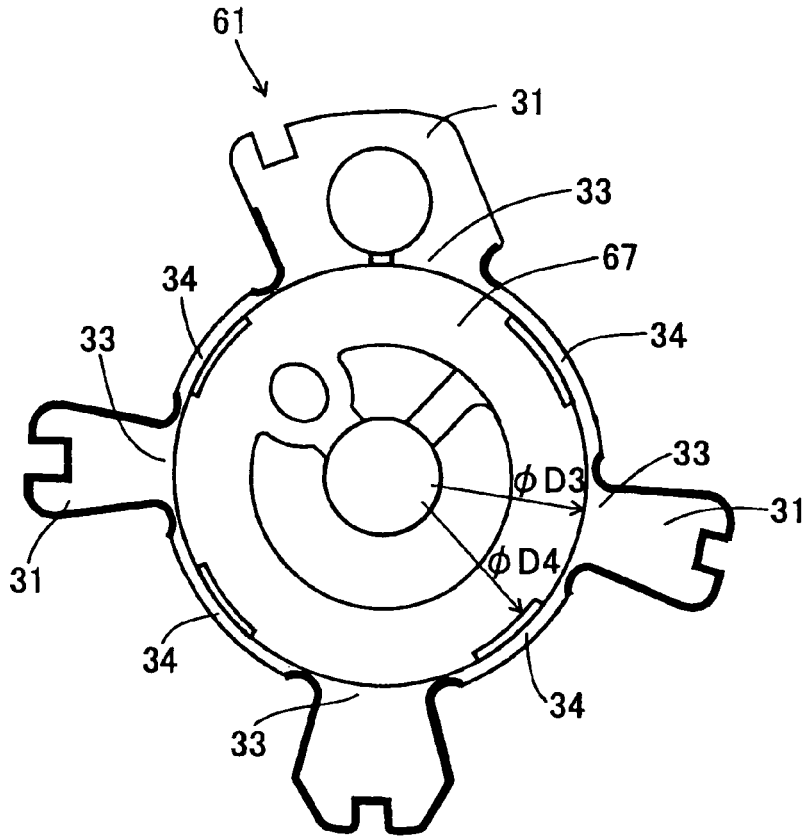
FIG. 3 is a front view showing a rotor vane of a valve timing control apparatus according to a second embodiment.

As shown in FIG. 3, a rotor vane 61 has thick portions 33 and thin portions 34 that define a press-insertion hole 67 radially therein. The thick portions 33 and the thin portions 34 are partially applied with, for example, a machining work, such that the inner diameter of the thick portions 33 is different from the inner diameter of the thin portions 34. Thus, the rotor vane 61 has a structure different from the conventional structure shown in FIGS. 5A, 5B.

Specifically, the radially inner periphery of the thick portions 33 are further cut by, for example the machining work, compared with the radially inner periphery of the thin portions 34.

The thick portions 33 define the inner circumferential periphery having the inner diameter D3. The thin portions 34 define the inner circumferential periphery having the inner diameter D4. The press-inserted portion 93 of the conventional bushing vane 91 has the outer diameter D2. The inner diameter D3 is equal to or greater than the outer diameter D2, and the inner diameter D4 is less than the outer diameter D2 (D3≧D2≧D4). In this structure, stress and deformation arise substantially in the thin portion 34 when the conventional bushing vane 91 (FIGS. 5A, 5B), which has a substantially circumferential end surface, is press-inserted into the rotor vane 61. Thus, the thick portions 33 can be substantially restricted from causing stress and deformation therein, by applying the machining work for cutting the inner circumferential periphery of the rotor vane 61. In this structure, an effect equivalent to that in the first embodiment shown in FIGS. 1A, 1B can be produced.

In the above embodiment, the cam 120 of the camshaft 110 may manipulate to open and close either the intake valve 130 or the exhaust valve 131.

In the above first and second embodiments, the valve timing control apparatus 1 includes the camshaft 110, the housing member 2, and the rotor member 3. The camshaft 110 opens and closes at least one of the intake valve 130 and the exhaust valve 131 of the engine 100. The housing member 2 rotates together with one of the camshaft 110 and the crankshaft 111 of the internal combustion engine 100. The rotor member 3 is accommodated in the housing member 2, and is substantially coaxial with the housing member 2. The rotor member 3 rotates with the other of the camshaft 110 and the crankshaft 111. The rotor member 3 is rotatable with respect to the housing member 2 in a predetermined angular range. The rotor member 3 includes the rotor vane 31 and the bushing vane 41. The rotor vane 31 is in a substantially cylindrical shape. The rotor vane 31 has the thick portion 33, which constructs a part of the circumferential periphery of the rotor vane 31. The rotor vane 31 has the thin portion 34, which constructs the other part of the circumferential periphery of the rotor vane 31 than the thick portion 33. The rotor vane 31 has one end surface defining the engage hole 35 in which the other of the camshaft 110 and the crankshaft 111 engages. The rotor vane has the other end surface defining the press-insertion hole 37. The bushing vane 41 is in a substantially cylindrical shape. The bushing vane 41 has one end surface that is press-inserted into the press-insertion hole 37. The one end surface of the bushing vane 41 has the predetermined compression margin with respect to the thin portion 34. The one end surface of the bushing vane 41 does not have the predetermined compression margin with respect to the thick portion 33.

In this structure, when the rotor vane 31, which constructs the rotor member 3, is press-inserted into the bushing vane 41, deformation in the rotor member 3 can be reduced. Thus, reliability and productivity of the valve timing control apparatus 1 can be enhanced.

In the above first and second embodiments, the housing member 2 rotates in conjunction with the crankshaft 111, and the rotor member 3 rotates together with the camshaft 110. Alternatively, the housing member 2 may rotate together with the camshaft 110, and the rotor member 3 may rotate together with or in conjunction with the crankshaft 111.

In the above embodiments, the housing member 2 is indirectly driven from the crankshaft 111 via the transmission device 140 such as a belt and a chain. Alternatively, the housing member 2 may be directly connected with the crankshaft 111 to be directly driven from the crankshaft 111. The housing member 2 may be directly geared with the crankshaft 111.

In the above embodiments, the rotor member 3 is accommodated coaxially in the housing member 2, so that the rotor member 3 is rotatable together with the camshaft 110. The rotor member 3 is rotatable relative to the housing member 2 in the predetermined angular range. The relative angle or the relative phase between the rotor member 3 and the housing member 2 is controlled using, for example, the hydraulic device. The camshaft 110 has the cam 120 for actuating the valve 130, 131. The camshaft 110 engages with the engage hole 35 defined by the one bottom end surface of the rotor vane 31, which constructs the rotor member 3, so that the camshaft 110 is rotatable integrally with the rotor vane 31.

The rotor member 3 is assembled by press-inserting the bushing vane 41 into the rotor vane 31, in consideration of productivity and manufacturing cost to construct the rotor member 3 in a complicated shape. The rotor vane 31 is accommodated in the housing member 2, such that the rotor vane 31 rotates relative to the housing member 2. The rotor vane 31 has the thick portion 33, which constructs the part of the circumferential periphery of the rotor vane 31. The rotor vane 31 has the thin portion 34, which constructs the other part of the circumferential periphery of the rotor vane 31 than the thick portion 33.

The thick portion 33 of the rotor vane 31 is the vane portion 32 that is accommodated in the cavity of the housing member 2 such that the vane portion 32 is rotatable relative to the housing member 2. The cavity of the housing member 2 is partitioned by the island portions into multiple hydraulic chambers. The vane portions 32 protrude radially from the outer periphery of the rotor vane 31. The vane portions 32 are hydraulically controlled relatively in the hydraulic chamber, so that the valve timing is controlled. The rotor vane 31 has the portions, in which the vane portions 32 are provided to construct the thick portions 33. The rotor vane 31 has the portions, in which the vane portions 32 are not provided, constructing the thin portions 34. The thick portions 33 and the thin portions 34 are circumferentially arranged alternately relative to each other. The number of the thick portions 33 is equal to the number of the vane portions 32. The number of the thin portions 34 is also equal to the number of the vane portions 32.

The one bottom end surface of the rotor vane 31 defines the engage hole 35 in which the camshaft 110 engages. Preferably, the inner diameter of the engage hole 35 is slightly greater than the outer diameter of the camshaft 110, so as to possibly reduce misalignment of the axes therebetween. The other bottom end surface of the rotor vane 31 has the press-insertion hole 37, which has the cross section in a substantially annular shape. The bushing vane 41 is press-inserted into the press-insertion hole 37.

The bushing vane 41 is in a substantially cylindrical shape. The one end of the bushing vane 41 is press-inserted into the press-insertion hole 37, so that the bushing vane 41 is coaxially coupled with the rotor vane 31.

The outer periphery of the bushing vane 41 is slidable relative to the inner surface of the housing member 2. In this structure, the bushing vane 41 and housing member 2 have the common axis, so that the bushing vane 41 is smoothly rotatable relative to the housing member 2. Preferably, another component such as the camshaft 110 may be arranged to slide relative to the housing member 2. In this structure, the camshaft 110 and the housing member 2 have the common axis therebetween.

The coil spring 5 is supported in the bushing vane 41. The one end of the coil spring 5 is hooked to the housing member 2, and the other end of the coil spring 5 is hooked to the rotor vane 31, so that the coil spring 5 biases the rotor vane 31 in the specific rotative direction relative to the housing member 2.

The coil spring 5 defines the rotative position of the housing member 2 relative to the rotor vane 31 when the hydraulic device does not control the rotation of the housing member 2 relative to the rotor vane 31. The inner diameter of the bushing vane 41 is preferably slightly greater than the outer diameter of the coil spring 5, so that the bushing vane 41 is capable of stably supporting the coil spring 5.

In the above embodiments, the bushing vane 41, which is in a substantially cylindrical shape, has the one end that has the predetermined compression margin with respect to the thin portion 34 partially defining the press-insertion hole 37. The one end surface of the bushing vane 41 does not have the predetermined compression margin with respect to the thick portion 33 partially defining the press-insertion hole 37.

In general, press-insertion is performed in such a manner that two components, which have slight dimensional overlapping portions, are applied with force to deform thereof so that the two components are secured to each other. When one of the components is press-inserted into the other of the components, the overlapping portions are deformed so as to apply residual stress to the components, so that the components can be rigidly connected with each other. The dimension of the deformation caused in the overlapping portions defines the compression margin.

The press-insertion hole 37 of the rotor vane 31 has the cross section in a substantially annular shape. The bushing vane 41 has the end having the notches 42 opposed to the portion of the press-insertion hole 37 defined by the thick portions 33 radially therein. In this structure, the end of the bushing vane 41 is press-inserted into the portion of the press-insertion hole 37 defined substantially only by the thin portions 34 radially therein. In the conventional structure shown in FIGS. 5A, 5B, the annular end of the conventional bushing vane 91 is entirely press-inserted into the press-insertion hole 37, regardless of the thick portions 33 and the thin portions 34. Consequently, in this conventional structure, the conventional bushing vane 91 largely deforms. By contrast, in the above first embodiment, the end of the bushing vane 41 is partially cut to circumferentially define the notches 42. The notches 42 are located in the press-insertion hole 37 defined by the thick portions 33 radially therein when the end of the bushing vane 41 is press-inserted into the press-insertion hole 37. Thus, in this structure, deformation caused in the bushing vane 41 can be reduced when the bushing vane 41 is press-inserted into the press-insertion hole 37.

When the notches 42 are excessively large, the mechanical strength of the bushing vane 41 may become insufficient. Preferably, the dimension of each of the notches 42 is circumferentially greater than the dimension of the corresponding one thick portion 33. Preferably, the axial length of each of the notches 42 is greater than the press-insertion length by which the bushing vane 41 is press-inserted into the press-insertion hole 37. The axial length of the notch 42 is the height of the notch 42 by which the notch 42 is recessed from the axial end surface of the bushing vane 41. The number of the notches 42 may be the same as the number of the thick portions 33.

In the above second embodiment, the end of the bushing vane 41 is in a substantially annular shape having the predetermined outer diameter. The thick portions 33, which partially define the press-insertion hole 37 radially therein, have the radially inner periphery having the inner diameter that is greater than the outer diameter of the end of the bushing vane 41. The thin portions 34, which partially define the press-insertion hole 37 radially therein, have the radially inner periphery having the inner diameter that is less than the outer diameter of the end of the bushing vane 41. The bushing vane 41 has the substantially cylindrical end having the substantially annular cross section. The radially inner periphery of the rotor vane 31 defining the press-insertion hole 37 is applied with, for example, a machining work, such that the radially inner periphery of the thick portions 33 is greater than the radially inner periphery of the thin portions 34 in inner diameter.

In this structure, when the bushing vane 41 is press-inserted into the rotor vane 31, the press-insertion hole 37 partially defined by the thick portions 33 does not radially overlap the bushing vane 41, and the press-insertion hole 37 partially defined by the thin portions 34 radially overlap the bushing vane 41. In this structure, the thick portions 33 are not apt to largely deform, so that stress caused in the thick portions 33 can be reduced. By contrast, the thin portions 34 are radially expanded by the bushing vane 41, and the bushing vane 41 is radially compressed by the thin portions 34. In this condition, the thin portions 34 are low in rigidity in the rotor vane 31, so that deformation due to stress caused in the components is restricted substantially within the vicinity of the press-insertion hole 37. Therefore, the engage hole 35 on the axially opposite side of the press-insertion hole 37 can be substantially protected from the stress and deformation arising in the vicinity of the press-insertion hole 37. Thus, the engage hole 35 can be maintained in the predetermined dimension during the press-insertion, so that the camshaft 110 can be steadily engaged in the engage hole 35 in the manufacturing process subsequent to this press-insertion.

Various modifications and alternations may be diversely made to the above embodiments without departing from the spirit of the present invention.

What is claimed is:

1. A valve timing control apparatus for controlling at least one of an intake valve and an exhaust valve of an internal combustion engine having a driving shaft, the valve timing control apparatus comprising:

a driven shaft for actuating the at least one of the intake valve and the exhaust valve;

a housing member for rotating together with one of the driven shaft and the driving shaft; and a rotor member accommodated coaxially in the housing member for rotating together with an other of the driven shaft and the driving shaft, the rotor member being rotatable with respect to the housing member in a predetermined angular range, wherein the rotor member includes a rotor vane that has a thick portion, which constructs a circumferential part of the rotor vane, and a thin portion, which constructs a circumferential part of the rotor vane other than the thick portion, the thick portion is greater than the thin portion in thickness with respect to a radial direction of the rotor vane, the rotor vane has one end surface defining an engage hole in which the other of the driven shaft and the driving shaft engages, the rotor vane has an other end surface defining a press-insertion hole, the rotor member further includes a bushing vane, in a substantially cylindrical shape, having one end, the one end of the bushing vane is connectable to the rotor vane through the press-insertion hole with a compression margin relative to the thin portion, and the one end of the bushing vane is connectable to the rotor vane through the press-insertion hole without a compression margin relative to the thick portion.

2. The valve timing control apparatus according to claim 1, wherein the one end of the bushing vane has the compression margin with respect to the thin portion, and the one end of the bushing vane does not have the compression margin with respect to the thick portion.

3. The valve timing control apparatus according to claim 1, wherein the housing member defines a cavity that rotatably accommodates the thick portion, and the thick portion has a vane portion that is rotatable relative to the housing member.

4. The valve timing control apparatus according to claim 1, wherein the bushing vane has an outer periphery that is slidable relative to the housing member.

5. The valve timing control apparatus according to claim 1, further comprising:

a coil spring that has one end hooked to the housing member, the coil spring further having an other end hooked to the rotor vane, wherein the coil spring biases the rotor vane in a specific rotative direction relative to the housing member, and the coil spring is supported in the bushing vane.

6. The valve timing control apparatus according to claim 1, wherein the press-insertion hole is substantially annular in cross-section, the one end of the bushing vane is partially recessed inwardly with respect to an axial direction of the bushing vane to define a notch, and when the one end of the bushing vane is press-inserted into the press-insertion hole, the notch is located in a part of the press-insertion hole radially inwardly defined by the thick portion.

7. The valve timing control apparatus according to claim 1, wherein the press-insertion hole is substantially annular in cross-section, the one end of the bushing vane has a protrusion that extends outwardly with respect to an axial direction of the bushing vane, and when the bushing vane is connected with the rotor vane by press-inserting the protrusion into the press-insertion hole, the protrusion overlaps with the thin portion with respect to the radial direction, and the thick portion defines a space, which is a part of the press-insertion hole, on an inner side of the thick portion with respect to the radial direction.

8. The valve timing control apparatus according to claim 7, wherein the protrusion has a circumscribed circle coaxially with the bushing vane, and the circumscribed circle has a diameter that is greater than a diameter of the press-insertion hole.

9. The valve timing control apparatus according to claim 1, wherein the one end of the bushing vane is in a substantially annular shape having an outer diameter, the thick portion at least partially defines the press-insertion hole on an inner side of the thick portion with respect to the radial direction, the thick portion has an inner diameter that is greater than the outer diameter of the bushing vane, the thin portion at least partially defines the press-insertion hole on an inner side of the thin portion with respect to the radial direction, and the thin portion has an inner diameter that is less than the outer diameter of the bushing vane.

10. The valve timing control apparatus according to claim 1, wherein the thick portion has a first inscribed circle, coaxial with the rotor vane, having a first diameter, the thin portion has a second inscribed circle, coaxial with the rotor vane, having a second diameter, the one end of the bushing vane has a circumscribed circle having a third diameter, the first diameter is equal to or greater than the third diameter, and the third diameter is greater than the second diameter.

11. A valve timing control apparatus for controlling at least one of an intake valve and an exhaust valve of an internal combustion engine having a driving shaft, the valve timing control apparatus comprising:

a driven shaft for actuating the at least one of the intake valve and the exhaust valve;

a housing member for rotating together with one of the driven shaft and the driving shaft; and a rotor member accommodated coaxially in the housing member for rotating together with an other of the driven shaft and the driving shaft, the rotor member being rotatable with respect to the housing member in a predetermined angular range, wherein the rotor member includes a rotor vane that has a plurality of thick portions and a plurality of thin portions, each of the plurality of thick portions and each of the plurality of thin portions are circumferentially arranged one another to define a press-insertion hole therein with respect to a radial direction of the rotor vane, each of the plurality of thick portions is greater than each of the plurality of thin portions in thickness with respect to the radial direction, the rotor member further includes a bushing vane, in a substantially cylindrical shape, having one end, the one end of the bushing vane is connectable to the rotor vane through the press-insertion hole with a compression margin relative to the thin portion, and the one end of the bushing vane is connectable to the rotor vane through the press-insertion hole without a compression margin relative to the thick portion.

12. The valve timing control apparatus according to claim 11, wherein the press-insertion hole is substantially annular in cross-section, the one end of the bushing vane has a plurality of protrusions that extends outwardly with respect to an axial direction of the bushing vane, the plurality of protrusions are circumferentially arranged to define a plurality of notches adjacently therebetween, and when the bushing vane is connected with the rotor vane by press-inserting the plurality of protrusions into the press-insertion hole, the plurality of protrusions overlaps respectively with the plurality of thin portions with respect to the radial direction, and the plurality of notches is located respectively on an inner side of the plurality of thick portions with respect to the radial direction.

13. The valve timing control apparatus according to claim 12, wherein the plurality of protrusions has a circumscribed circle having a diameter that is greater than a diameter of the press-insertion hole.

14. The valve timing control apparatus according to claim 11, wherein the plurality of thick portions has a first inscribed circle having a first diameter, the plurality of thin portions has a second inscribed circle having a second diameter, the one end of the bushing vane has a circumscribed circle having a third diameter, the first diameter is equal to or greater than the third diameter, and the third diameter is greater than the second diameter.

* * * * *